US009210988B2

(12) United States Patent
Kim

(10) Patent No.: US 9,210,988 B2
(45) Date of Patent: Dec. 15, 2015

(54) ADJUSTABLE COSMETIC APPLICATOR

(71) Applicant: AA R&D LLC, Leonia, NJ (US)

(72) Inventor: Tae Yeon Kim, Fort Lee, NJ (US)

(73) Assignee: AA R&D LLC, Leonia, NJ (US)

( * ) Notice: Subject to any disclaimer, the term of this patent is extended or adjusted under 35 U.S.C. 154(b) by 161 days.

(21) Appl. No.: 13/777,801

(22) Filed: Feb. 26, 2013

(65) Prior Publication Data

US 2014/0016984 A1 Jan. 16, 2014

(30) Foreign Application Priority Data

Jul. 13, 2012 (KR) ..... 10-2012-0076397

(51) Int. Cl.
*A46B 11/00* (2006.01)
*A45D 40/26* (2006.01)
*A46B 5/00* (2006.01)

(52) U.S. Cl.
CPC ..... *A45D 40/265* (2013.01); *A46B 5/0083* (2013.01); *A46B 2200/1053* (2013.01)

(58) Field of Classification Search
CPC ..... A45D 40/265; A45D 5/0083; A45D 2200/1053
USPC ..... 401/126–130
See application file for complete search history.

(56) References Cited

U.S. PATENT DOCUMENTS

| | | | | |
|---|---|---|---|---|
| 4,428,388 | A * | 1/1984 | Cassai et al. | 132/218 |
| 5,137,038 | A * | 8/1992 | Kingsford | 132/218 |
| 6,158,913 | A * | 12/2000 | Dumler et al. | 401/191 |
| 6,309,125 | B1 * | 10/2001 | Peters | 401/127 |
| 8,556,528 | B2 * | 10/2013 | Gardner et al. | 401/127 |
| 8,568,048 | B2 * | 10/2013 | Chan | 401/127 |
| 8,783,989 | B2 * | 7/2014 | Weigel et al. | 401/127 |
| 2008/0107470 | A1 * | 5/2008 | Gueret | 401/129 |

* cited by examiner

*Primary Examiner* — Jennifer C Chiang
(74) *Attorney, Agent, or Firm* — Westerman, Hattori, Daniels & Adrian, LLP

(57) ABSTRACT

An adjustable cosmetic applicator including a handle unit adapted to be used as a cap coupled to a cosmetic container body; a rod unit adapted to be manipulated by means of the handle init; and an applying unit adapted to be operated cooperatively with the rod unit in such a manner as to be adjusted in angle. The adjustable cosmetic applicator allows the angle of the applying unit to be adjusted arbitrarily by means of the user, thereby permitting the cosmetic liquid to be applied in more natural and comfortable manners and further achieving the make-up according to the user's applying habit or preference.

6 Claims, 5 Drawing Sheets

ADJUSTABLE COSMETIC APPLICATOR

CROSS REFERENCE TO RELATED APPLICATIONS

This application claims the benefit under 35 USC 119 and/or 365 of Republic of Korea Application No. 10-2012-0076397 filed on Jul. 13, 2012 entitled "ADJUSTABLE COSMETIC APPLICATOR". The contents of the above-identified Application is relied upon and incorporated herein by reference in its entirety.

BACKGROUND OF THE INVENTION

1. Field of the Invention

The present invention relates to a cosmetic applicator, and more particularly, to an adjustable cosmetic applicator that allows an applying unit through which a cosmetic liquid is applied to be adjusted in angle thereof by means of a user's manipulation.

2. Background of the Related Art

Generally, mascara, which is one kind of cosmetic products, is used to apply various colors of mascara liquids to eyelashes to enhance the eyes. The mascara largely includes a handle and a brush, onto which a mascara liquid is applied.

So as to apply the mascara liquid to a user's eyelashes, first, the brush is inserted into a mascara case into which the mascara liquid is contained and is coated with the mascara liquid, and next, the brush is rotated on the eyelashes to raise the eyelashes upwardly, so that the mascara liquid is applied fully to the eyelashes to make them curvedly erected.

However, the above-mentioned conventional mascara has the handle and the brush arranged in a straight line, which gives many inconveniences in use.

For example, the make-up is conducted in the state where the eyelashes and the brush are arranged in a parallel with each other, and at this time, a user' arm should be raised to her shoulder's height to make the brush located in parallel with her eyelashes, which causes her make-up operation to be performed in an unstable posture, thereby resulting in bad make-up.

SUMMARY OF THE INVENTION

Accordingly, the present invention has been made in view of the above-mentioned problems occurring in the prior art, and it is an object of the present invention to provide an adjustable cosmetic applicator that allows an applying unit through which a cosmetic liquid is applied to be adjusted in angle thereof by means of a user's manipulator caused by her applying habit or preference.

To accomplish the above object, according to the present invention, there is provided an adjustable cosmetic applicator including: a handle unit adapted to be used as a cap coupled to a cosmetic container body; a rod unit adapted to be manipulated by means of the handle unit; and an applying unit adapted to be operated cooperatively with the rod unit in such a manner as to be adjusted in angle.

According to the present invention, desirably, the handle unit is formed of a hollow tube and has a rod guide tube extended in a direction to be coupled to the cosmetic container body and a rotation manipulation unit coupled in idleable manner to the opposite side to the rod guide tube in such a manner as to manipulate the linear motion of the rod unit.

According to the present invention, desirably, the rod unit has a screw portion formed on one end thereof in such a manner as to be screw-coupled to the rotation manipulation unit, a rotation prevention wing formed at the upper side of the screw portion in such a manner as to be slidingly coupled to the inner periphery of the handle unit to guide the linear motion of the rod unit, and a rack driving part mounted on the applying unit side end portion thereof to convert the linear motion into a rotary motion.

According to the present invention, desirably, the rod guide tube inside the handle unit has a slide groove adapted to guide the slide motion of the rotation prevention wing.

According to the present invention, desirably, the applying unit has a brush rod haying a brush disposed at one end thereof and a pinion driving part disposed at the other end thereof in such a manner as to be rotated around a rotary shaft through the reception of the linear motion of the rod unit.

According to the present invention, desirably, the applying unit has an elastic member adapted to provide an elastic restoring force thereto, the elastic member being supported against the rod unit at one end thereof and against the applying unit at the other end thereof, around the rotary shaft.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an explanation on an adjustable cosmetic applicator according to the present invention will be in detail given with reference to the attached drawing.

Figure 1:
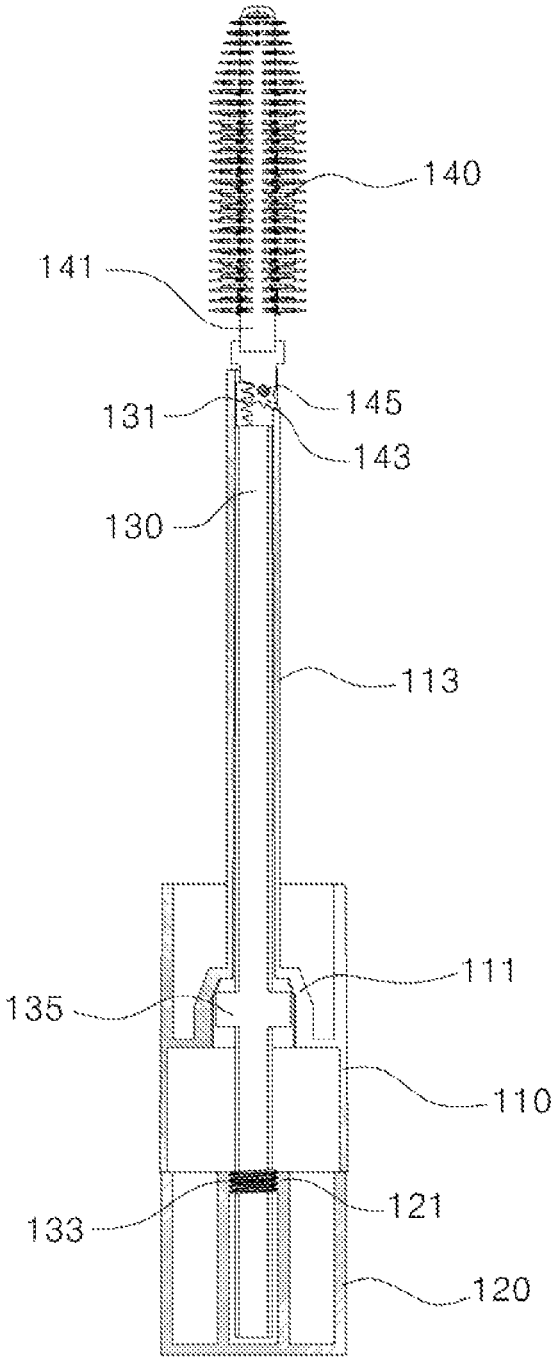
FIG. 1 is a sectional view showing the state before the operation of an adjustable cosmetic applicator according to the present invention.
Figure 2:
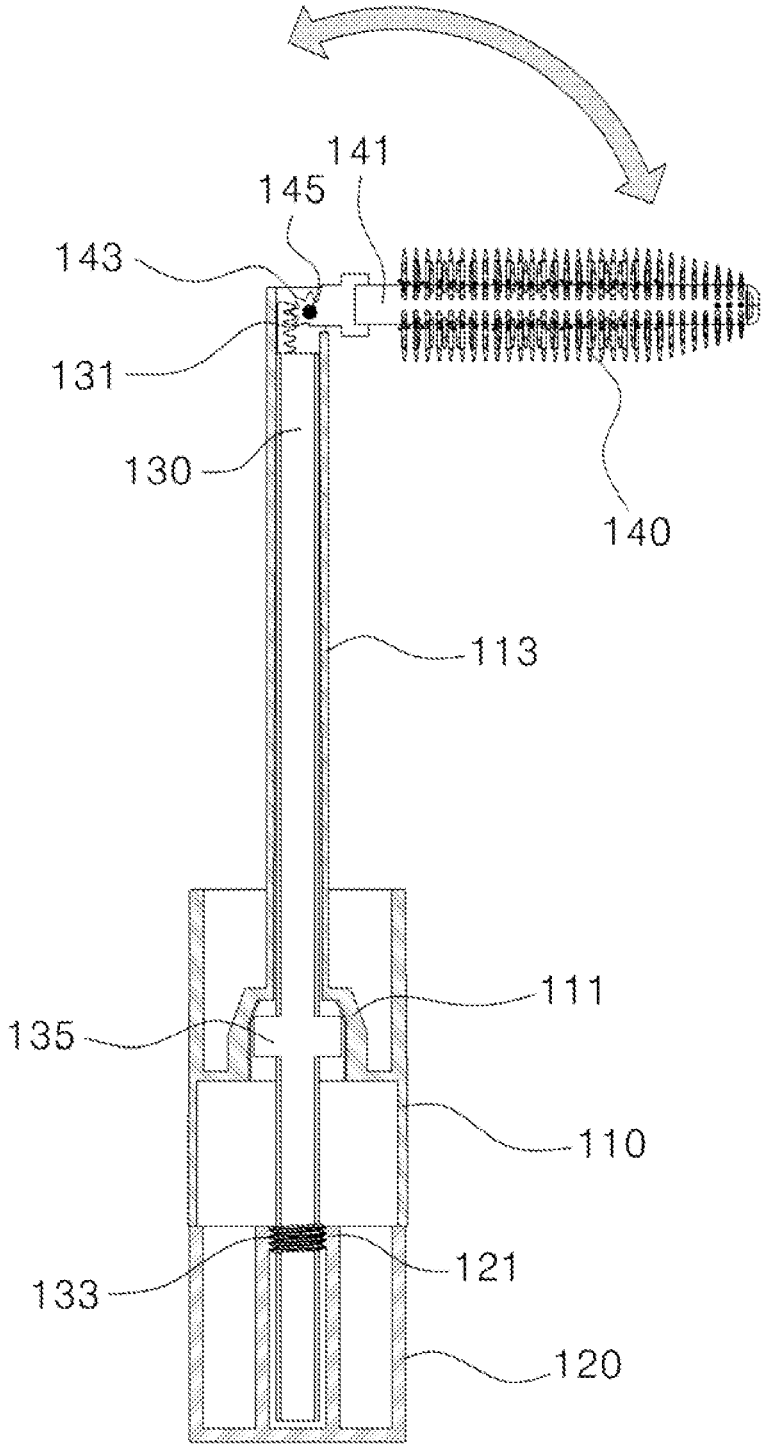
FIG. 2 is a sectional view showing the state after the operation of the adjustable cosmetic applicator according to the present invention.

FIG. 1 is a sectional view showing the state before the operation of an adjustable cosmetic applicator according to the present invention, and FIG. 2 is a sectional view showing the state after the operation of the adjustable cosmetic applicator according to the present invention.

Referring to FIGS. 1 and 2, an adjustable cosmetic applicator according to the present invention largely includes a handle unit 110, a rod unit 130 and an applying unit 140.

First of all, an explanation on the handle unit 110 of the adjustable cosmetic applicator according to the present invention will be given. The handle unit 110 is detachably mounted on a cosmetic container body (not shown), which is made in a form of a cap.

For example, a male screw portion is formed on the inlet side of the cosmetic container body, and a female screw portion is formed on the inner periphery of the handle unit 110 in such a manner as to be screw-coupled to the male screw portion of the cosmetic container body, thereby conducting the detachable coupling therebetween.

At this time, the handle unit 110 is formed of a hollow tube and has a rod guide tube 113 extended in a direction to be coupled to the cosmetic container body. The rod guide tube 113, which is adapted to be accommodated inside the cosmetic container body at the time when the handle unit 110 is coupled to the cosmetic container body, is formed integrally with the handle unit 110. The rod unit 130 is shaft-coupled to the rod guide tube 113 in such a manner as to be linearly moved.

Further, a rotation manipulation unit 120 is coupled in idleable manner to the opposite side to the handle unit 110.

At this time, the rotation manipulation unit 120 allows the rod unit 130 to be forwardly or backwardly moved in a linear direction in accordance with the rotating directions thereof, and the rotation manipulation unit 120 and the rod unit 130 are screw-coupled to each other.

Figure 3:
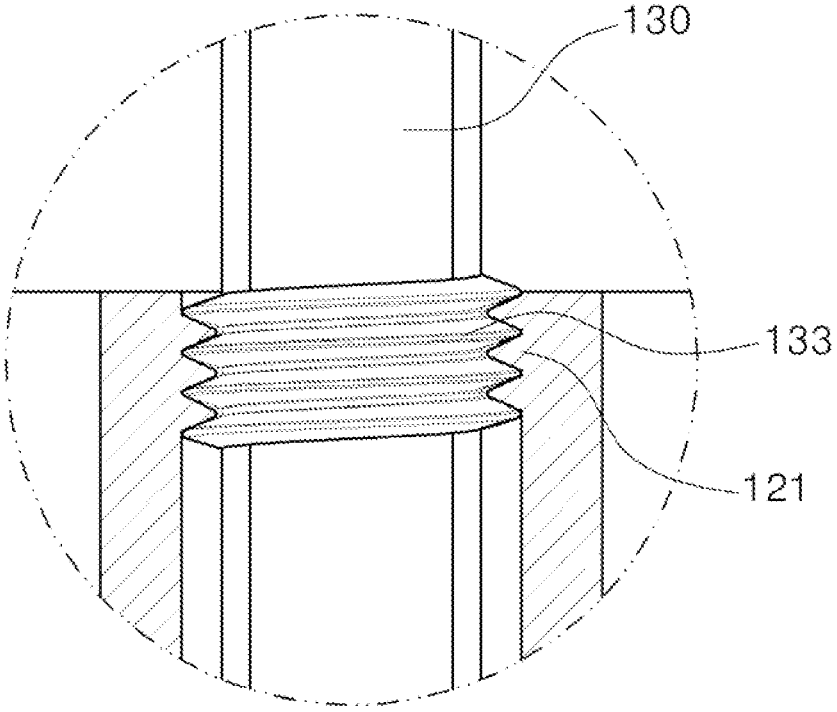
FIG. 3 is an enlarged sectional view showing a rotation manipulation unit of the adjustable cosmetic applicator according to the present invention.

FIG. 3 is an enlarged sectional view showing the rotation manipulation unit of the adjustable cosmetic applicator according to the present invention.

The rod unit 130 is formed of a post moved linearly by means of the manipulation of the handle unit 110 and has a screw portion 133 formed on one end thereof in such a manner as to be screw-coupled to the rotation manipulation unit 120. At this time, the rotation manipulation unit 120 has a screw guide portion 121 formed on one side thereof.

Further, the rod milt 130 has a rotation prevention wing 135 formed at the upper side of the screw portion 133 in such a manner as to be slidingly coupled to the inner periphery of the handle unit 110 to guide the linear motion of the rod unit 130. The rotation prevention wing 135 prevents the rod unit 130 from being rotated by means of the rotary force of the rotation manipulation unit 120, which is formed of a protrusion protruded outwardly form the outer periphery of the post. The protrusion may take a round or a plate.

At this time, a slide groove 111, which is adapted to guide the slide motion of the rotation prevention wing 135, is formed on the rod guide tube 113 inside the handle unit 110.

The slide groove 111 restricts the left and right motions of the rotation prevention wing 135 coupled thereto and also provides a moving path in a longitudinal direction.

The rod unit 130 has a rack driving part 131 mounted on the applying unit side end portion thereof to convert the linear motion into a rotary motion.

The rack driving part 131 is provided to a form of a screw thread on the linear rod one surface extended from the rod unit 130 and is engaged with a pinion driving part 143 having a round gear structure, thereby converting the linear motion into the rotary motion.

Figure 5:
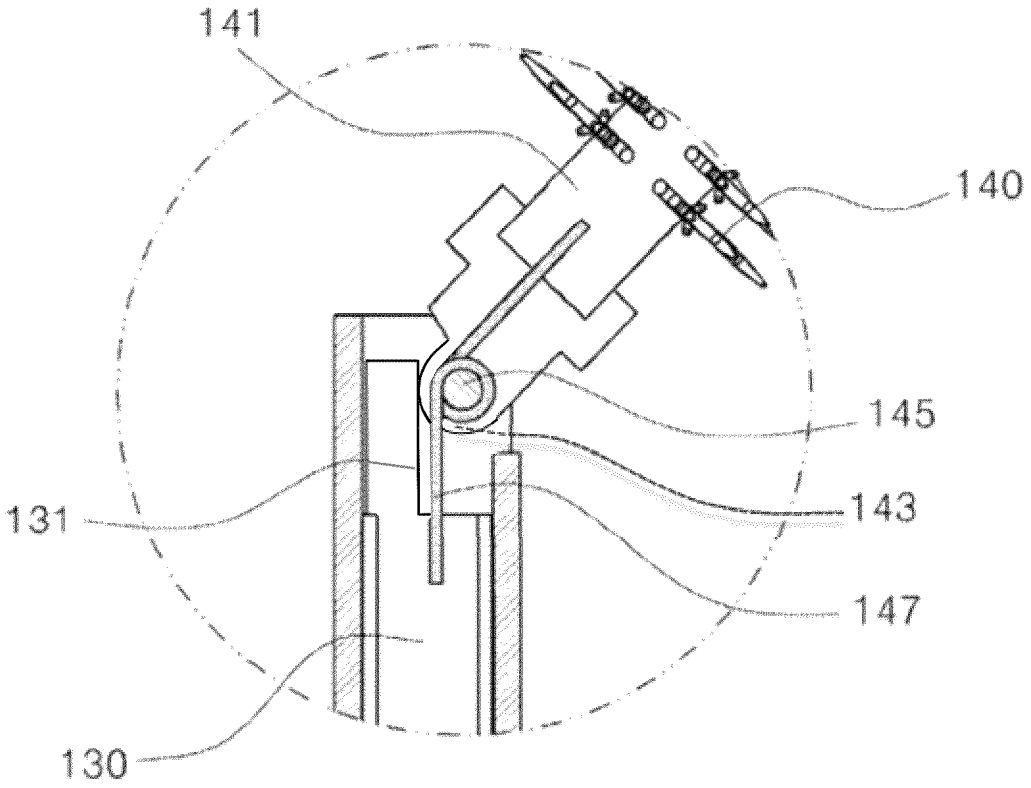
FIG. 5 is an enlarged sectional view showing another embodiment of the rack driving part and a pinion driving part of the adjustable cosmetic applicator.

At this time, the rack driving part 131 and the pinion driving part 143 may have a power transmission system through a frictional force, not through the gearing structure. For example, the surface of the rack driving part 131 is made of a material having a relatively high coefficient of friction like rubber, and also, the surface of the pinion driving part 143 is made of a material having a relatively high coefficient of friction like rubber, as illustrated in FIG. 5.

Next, the applying unit 140 will be described. The applying unit 140 is adjusted in angle in such a manner as to be operated cooperatively with the linear motion of the rod unit 130, and it has a brush rod 141 having a brush disposed at one end thereof to apply the cosmetic liquid therethrough.

At this time, the brush may be formed of bristles, sponges, or the like.

Also, the brush rod 141 has the pinion driving part 143 disposed at the other end thereof in such a manner as to be rotated around a rotary shaft 145 through the reception of the linear motion of the rod unit 130. As mentioned above, the pinion driving part 143 is formed of both of the gear and the rubber roller.

At this time, the applying unit 140 is coupled to the end of the rod guide tube 113 by means of the rotary shaft 145, thereby being rotated to a given angle (between 0° and 90°) around the rotary shaft 145.

Further, an elastic member 147 is disposed in such a manner as to be supported at one end thereof against the rod unit 130 and at the other end thereof against the applying unit 140, around the rotary shaft 145.

Figure 4:
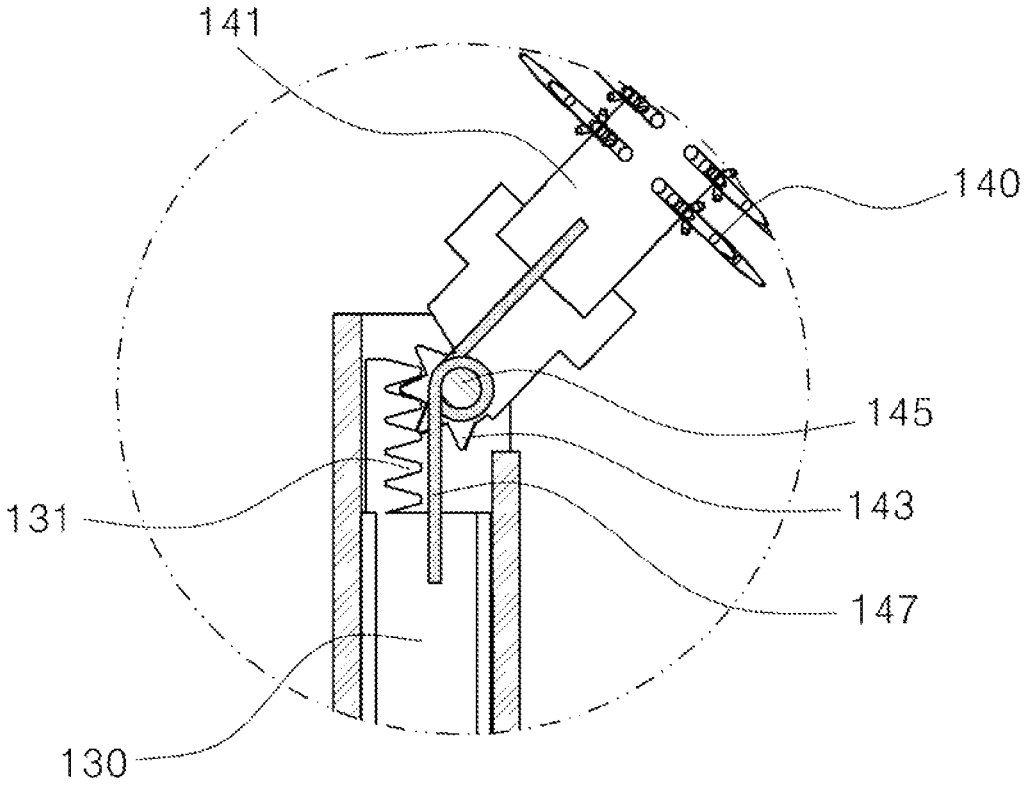
FIG. 4 is an enlarged sectional view showing a rack driving part and a pinion driving part of the adjustable cosmetic applicator according to the present invention.

FIG. 4 is an enlarged sectional view showing the rack driving part and the pinion driving part of the adjustable cosmetic applicator according to the present invention.

As shown in FIG. 4, the elastic member 147 is adapted to provide an elastic restoring force to the applying unit 140, so that after the completion of the make-up, the applying unit 140 can be returned to the state as shown in FIG. 1, without having any separate manipulation.

Next, an explanation on the operation of the adjustable cosmetic applicator according to the present invention will be given.

First, the handle unit 110 is separated from the cosmetic container body by means of a user's manipulation. After that, if the rotation manipulation unit 120 mounted on the handle unit 110 is rotated, the rod unit 130, which is inserted into the rod guide tube 113 of the handle unit 110, is linearly moved to convert the linear motion of the rack driving part 131 into the rotary motion of the pinion driving part 143.

At this time, the applying unit 140 having the pinion driving part 143 mounted thereon is rotated together, thereby allowing the angle of the applying unit 140 to be adjusted arbitrarily by means of the user. Accordingly, the adjustable cosmetic applicator according to the present invention allows the cosmetic liquid to be applied in more natural and comfortable manners and further achieves the make-up according to the user's applying habit or preference.

If the make-up is finished, next, the rotation manipulation unit 120 is rotated reversely to make the applying unit 140 located linearly with the rod unit 130, and after that, the handle unit 110 is accommodated into the cosmetic container body.

As described above, the adjustable cosmetic applicator according to the present invention allows the angle of the applying unit to be adjusted arbitrarily by means of the user, thereby permitting the cosmetic liquid to be applied in more natural and comfortable manners and further achieving the make-up according to the user's applying habit or preference.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An adjustable cosmetic applicator comprising:

a handle unit defining a hollow rod guide tube;

an applying unit pivotally connected to a free end of the rod guide tube; and a rod unit including a post extending within the rod guide tube, the post including a first end which engages the applying unit and a second, opposite end which extends within the handle unit and is associated with a manipulation unit supported by the handle unit, the manipulation unit is configured to move the post axially relative to the rod guide tube between a first position wherein an axis of the applying unit is parallel with an axis of the rod guide tube and a second position wherein the applying unit is pivoted such that the axis of the applying unit is at an acute or right angle relative to the axis of the rod guide tube;

wherein a non-toothed, frictional engagement extends between the first end of the post and a portion of the applying unit such that the applying unit is pivoted as the post is moved axially between the first and second positions.

2. The adjustable cosmetic applicator according to claim 1, wherein the rod unit has a screw portion formed on the second end the post in such a manner as to be screw-coupled to the manipulation unit with a rotation prevention wing formed at the upper side of the screw portion in such a manner as to be slidingly coupled to the inner periphery of the handle unit to guide the linear motion of the post.

3. The adjustable cosmetic applicator according to claim 2, wherein the rod guide tube inside the handle unit has a slide groove adapted to guide the slide motion of the rotation prevention wing.

4. The adjustable cosmetic applicator according to claim 1, wherein the applying unit has a brush rod having a brush disposed at one end thereof and an area of high friction material disposed at the other end thereof.

5. The adjustable cosmetic applicator according to claim 1, wherein the applying unit has an elastic member adapted to provide an elastic restoring force thereto, the elastic member being supported relative to the rod unit at one end thereof and against the applying unit at the other end thereof.

6. An adjustable cosmetic applicator comprising:

a handle unit defining a hollow rod guide tube;

an applying unit pivotally connected to a free end of the rod guide tube;

a rod unit including a post extending within the rod guide tube, the post including a first end which engages the applying unit and a second, opposite end which extends within the handle unit and is associated with a manipulation unit supported by the handle unit, the manipulation unit is configured to move the post axially relative to the rod guide tube between a first position wherein an axis of the applying unit is parallel with an axis of the rod guide tube and a second position wherein the applying unit is pivoted such that the axis of the applying unit is at an acute or right angle relative to the axis of the rod guide tube; and a spring member extending between the applying unit and the rod unit such that the spring member biases the applying unit toward the orientation wherein the axis of the applying unit is parallel with the axis of the rod guide tube.

* * * * *